US005255168A

United States Patent [19]

Stevens

[11] Patent Number: 5,255,168

[45] Date of Patent: Oct. 19, 1993

[54] ADJUSTABLE SAFETY LIGHT BELL

[76] Inventor: Katrine B. Stevens, 10 Hamilton St., Salem, Mass. 01970

[21] Appl. No.: 875,298

[22] Filed: Apr. 29, 1992

[51] Int. Cl.[5] ..... F21L 15/08

[52] U.S. Cl. ..... 362/108; 362/103; 362/191; 362/427

[58] Field of Search ..... 362/103, 105, 108, 190, 362/191, 287, 372, 418, 419, 427, 430

[56] References Cited

U.S. PATENT DOCUMENTS

| | | | |
|---|---|---|---|
| 1,741,264 | 12/1929 | Wappler | 362/105 |
| 3,225,982 | 12/1965 | Melton | 362/108 |
| 4,400,763 | 8/1983 | Kribs et al. | 362/103 |
| 4,974,130 | 11/1990 | Friedman | 362/191 |
| 5,045,979 | 9/1991 | Stevens | 362/103 |
| 5,063,483 | 11/1991 | Feilmeier et al. | 362/103 |

FOREIGN PATENT DOCUMENTS

| | | | |
|---|---|---|---|
| 481468 | 3/1952 | Canada | 362/105 |

*Primary Examiner*—Albert J. Makay
*Assistant Examiner*—Y. Quach
*Attorney, Agent, or Firm*—John P. McGonagle

[57] ABSTRACT

A belt with an adjustable light housing and holder attached centrally to the belt front. A flashlight is inserted into the holder housing. The housing is vertically adjustable so that the light illuminates a variety of optional areas in front of the belt wearer.

7 Claims, 6 Drawing Sheets

ADJUSTABLE SAFETY LIGHT BELL

BACKGROUND OF THE INVENTION

This invention relates to lighting of the body attached type, and more particularly to a belt with an adjustable safety light.

Poor visibility is a serious problem at night for pedestrians, outdoor workers, and outdoor exercisers, such as joggers and the like. The difficulty of maneuvering oneself safely on foot on a roadway, field or yard is well known to walkers, joggers, police officers, firefighters, construction workers, railroad workers, and maintenance men, especially if the person is carrying something or working with their hands.

There have been many attempts to increase pedestrian visibility such as brightly colored and/or reflective clothing. However, little has been done to provide visibility for the pedestrian other than with hand-held flashlights. These are impractical and inconvenient for those wishing to keep their hands free or for use with other tasks.

SUMMARY OF THE INVENTION

In view of the foregoing disadvantages inherent in the known types of devices now present in the prior art, the present invention provides a safety light belt. As such, the general purpose of the present invention, which will be described subsequently in greater detail, is to provide a light, attached to the person, which is adjustably aimed in front of the wearer downwardly at a point where he or she is about to step, forwardly and/or upwardly on a work piece or work area.

To attain this, the present invention provides a belt with an adjustable light holder mounted on the front thereof. A small light is mounted therein. The holder is so constructed that the light may be forwardly aimed upwardly, horizontally or downwardly of the belt wearer.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 2:
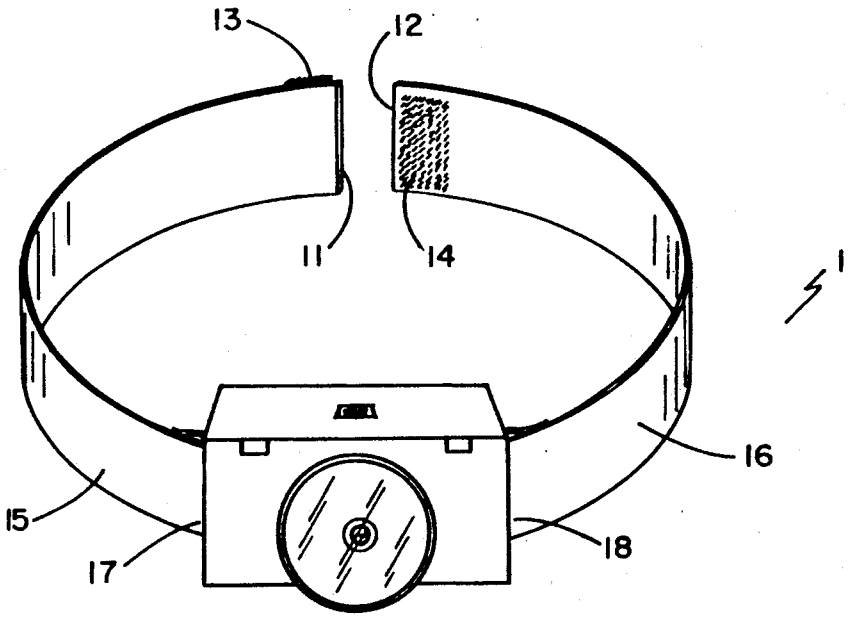
FIG. 2 is a top front perspective view of the light of FIG. 1.

Referring to the drawings in detail wherein like elements are indicated by like numerals, there is shown an embodiment of the invention 1 incorporating an adjustable safety light belt. The invention 1 is comprised of three elements, i.e., a belt 10, a holder 30, and a light housing 50. The belt 10 is attached around the trunk of a wearer (not shown) and is comprised of two pieces 15 and 16. The pieces 15, 16 each have an end 11 and 12, respectively, interconnected together with hook and loop fasteners 13 and 14. The other end 17, 18 of each piece 15, 16 is formed into a loop around side rings 36 attached to and positioned on either side 34 of a light holder 30. In another embodiment the belt 10 would be made of a single piece continuously threaded through the holder side rings 36 and across the back 31 of the light holder 30. Other type fasteners may also be used in place of the hook and loop fasteners described above, such as snaps, hooks, buckles, etc. The belt 10 in this embodiment is made of a sturdy "webbing" fabric, but other belt-like materials could also be used. A flat sponge may be attached to the back of the holder 30 for comfort.

The holder 30 in this embodiment has a generally rectangular shape and a preferred depth of one-half to one inch. Other dimensions and shapes could be used without deviating from the spirit of the invention. The holder 30 has a back 31, top 32, bottom 33, two sides 34, and a front 35. In this embodiment of the invention, the sides 34 are parallel to each other and perpendicular to the planes of the back 31, bottom 33 and top 32. A light housing assembly 50 with a light 51 contained therein is attached to a extension element 40 horizontally protruding from the front 35 of the holder 30.

Figure 1:
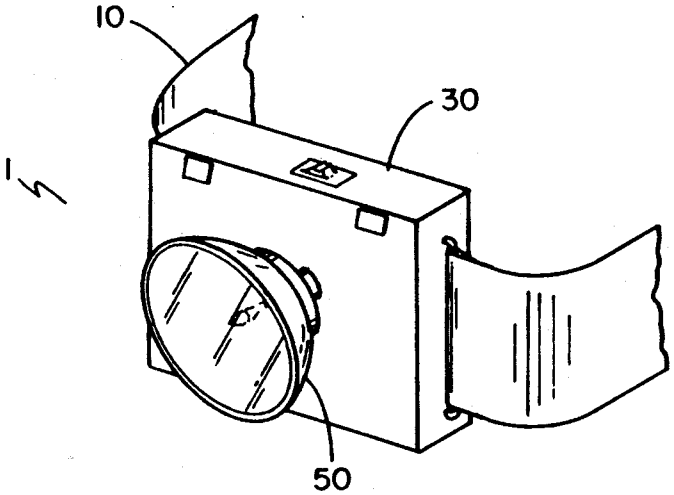
FIG. 1 is a perspective view of a safety light belt incorporating the features of the instant invention.
Figure 3:
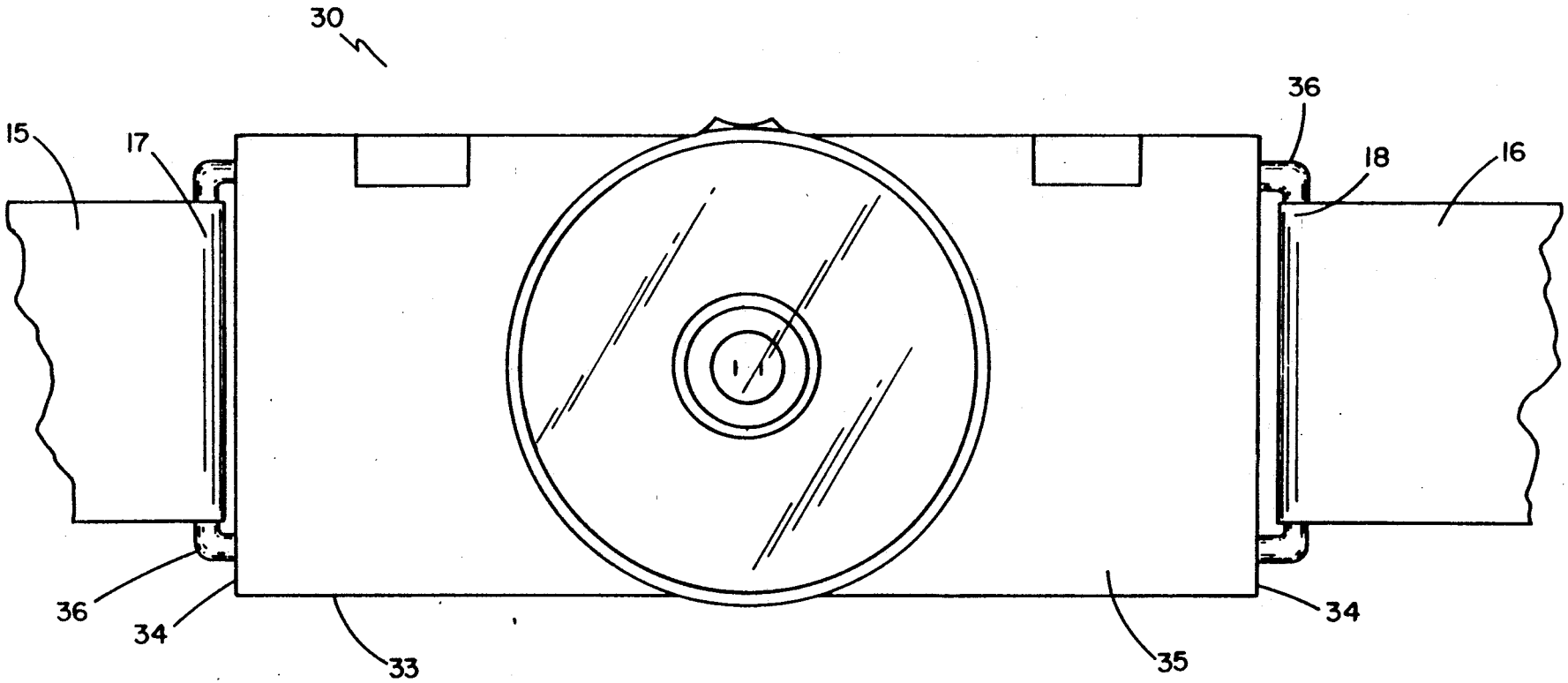
FIG. 3 is a front elevational view thereof.
Figure 6:
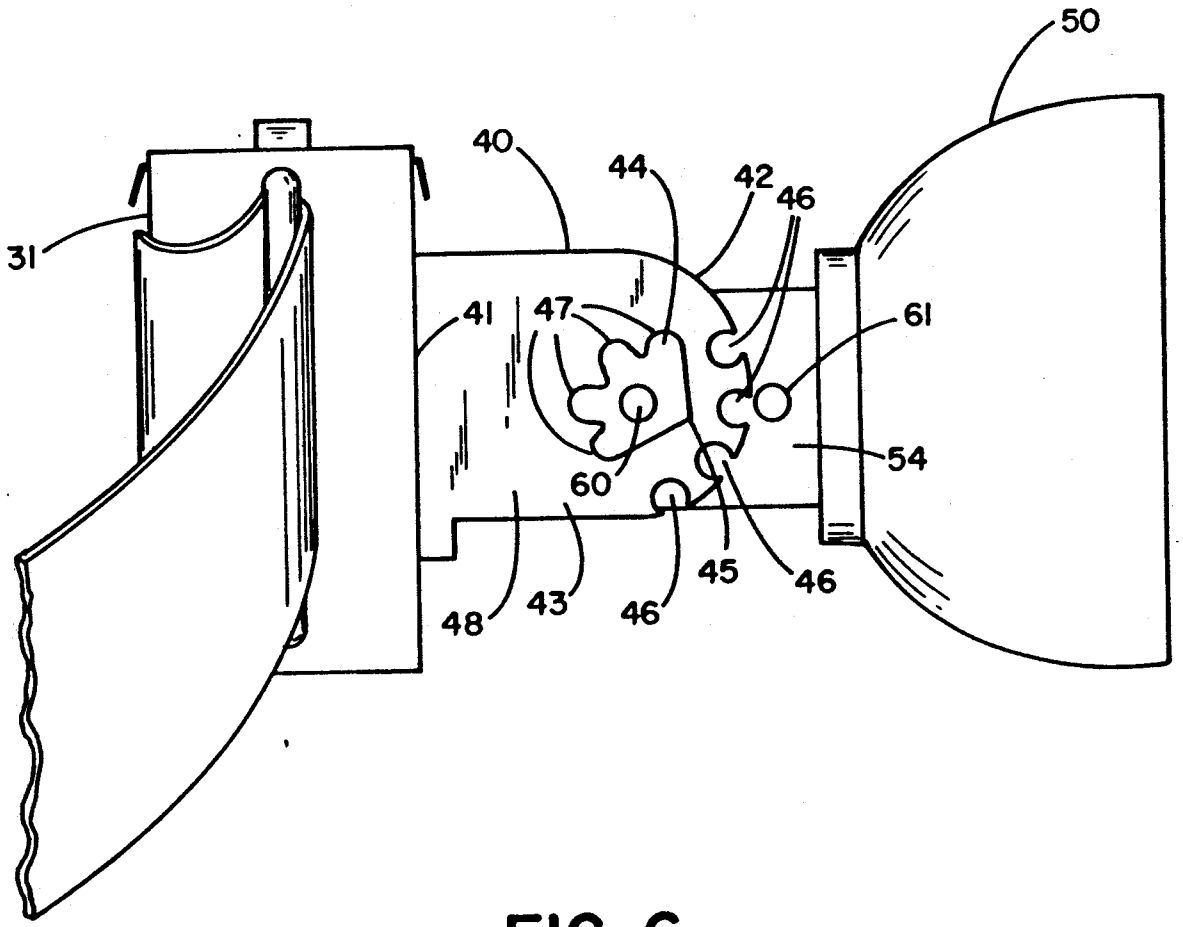
FIG. 6 is a side elevational view of the light of FIG. 1.
Figure 7:
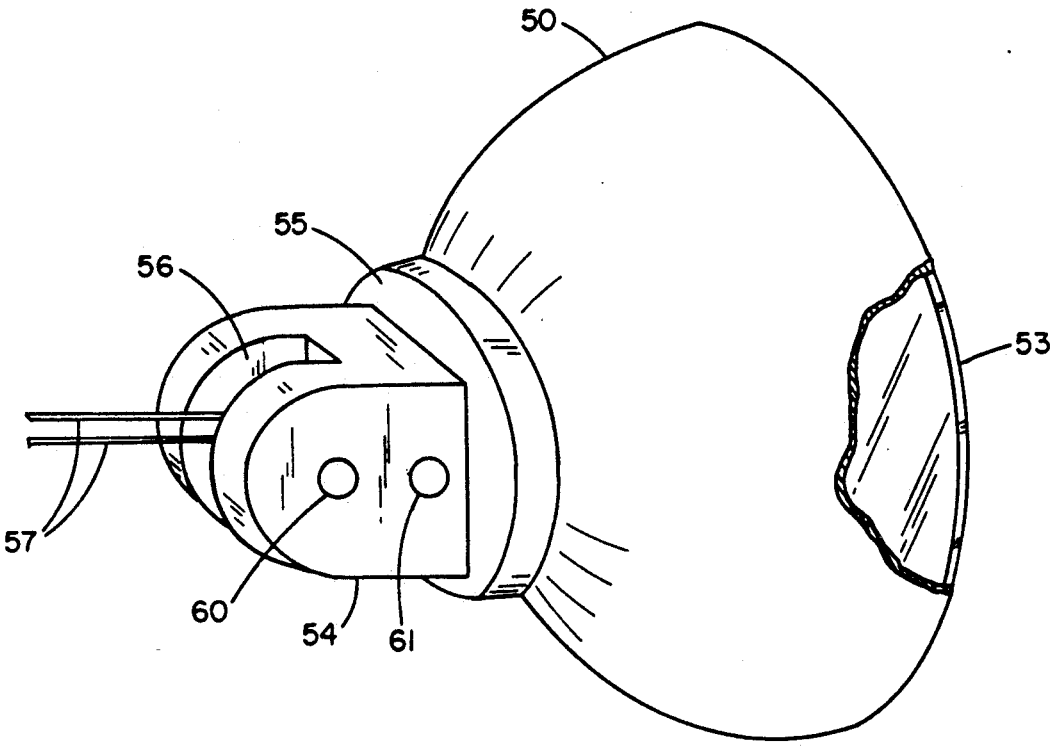
FIG. 7 is a side perspective view of the bulb housing.
Figure 8:
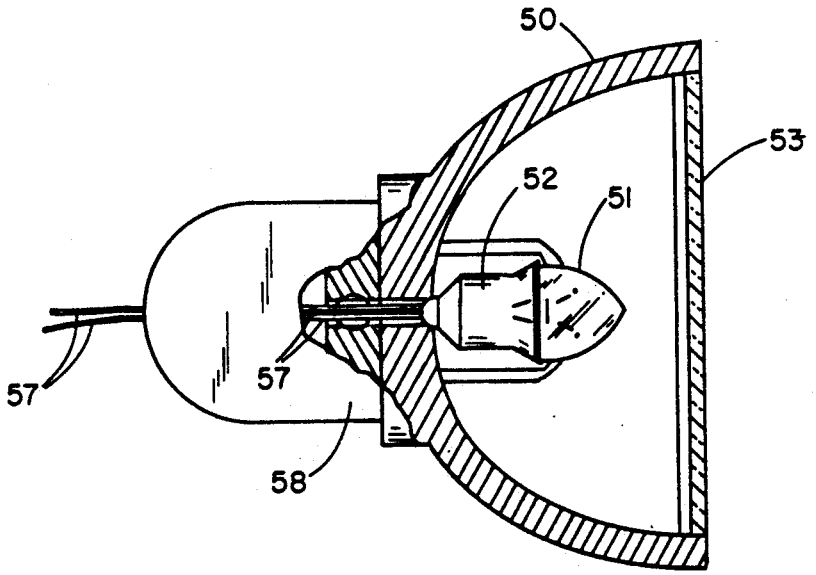
FIG. 8 is a side view of the bulb housing, partly in section.

Referring particularly to FIGS. 1, 6 and 7 the extension element 40 protrudes horizontally. The extension element 40 is formed into two flat, vertical prongs 48 (one shown), each having an external side 43, and has two ends, a holder end 41 and an extension end 42. The extension ends 42 are shaped into a semicircle and have a four open, radial notches 46 positioned with respect to a horizontal reference forward of the holder at +45 degrees, 0 degrees, −45 degrees and −90 degrees. At the approximate midpoint of the diameter chord line of the semicircle, an obtuse triangular opening 44 is formed along each extension element side 43. The corner of the triangular opening defined by the obtuse angle, the obtuse corner 45, is centered on the longitudinal axis of the extension element 40 and is the foremost point of the triangular opening 44. The side opposite the obtuse angle is formed into four open radial notches 47 corresponding in angular position to the extension element radial notches 46.

The light housing 50 has a conventional rounded shape with a light bulb 51 inserted into a conventional socket 52 contained therein. A transparent protective element 53 encloses the forward end of the housing 50. A horizontal extension element 54 is attached to the rear 55 of the housing 50. The extension element 54 has a central opening 56 for passage of wires 57 from the housing light socket 52. The extension element has two external sides 58 each containing two cylindrical, peg like protrusions 60, 61. The pegs 60, 61 are aligned horizontally along the central longitudinal axis of the extension element 54.

The Light housing extension element 54 is joined to the holder extension element 40 so that the housing extension 54 is positioned between holder extension element prongs 48. The housing extension element rearmost pegs, i.e., first pegs 60, are inserted into the obtuse triangular openings 44. The housing extension element foremost pegs, i.e., second pegs 61, remain forward of the holder extension element extension end 42. In operation the light housing 50 is pulled slightly forward away from the holder 30 and positioned at a desired angle. The light housing 50 is then pushed rearward toward the holder 30 wherein the first pegs 60 engage correspondingly positioned angular opening notches 47 and the second pegs 61 engage correspondingly positioned holder extension element angularly positioned notches 46. As stated above the notches 46 and 47 are open. However, the openings of both sets of notches 46, 47 are slightly less in dimension than the diameter of the pegs 60, 61. In effect, the light housing is "snapped" into a particular angular position.

Figure 4:
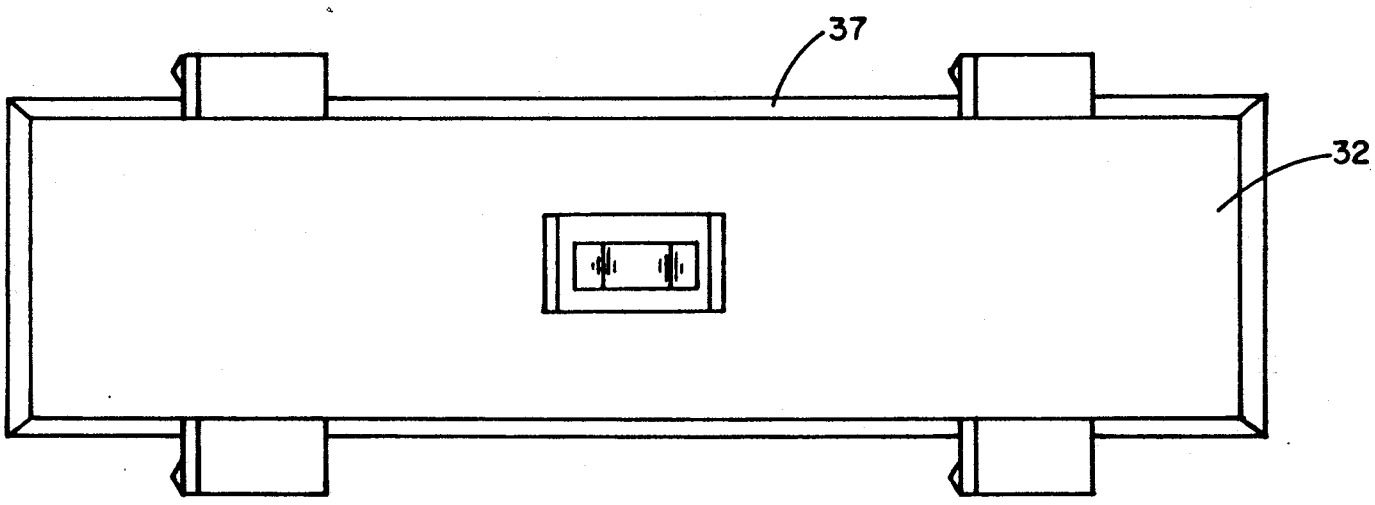
FIG. 4 is a top view of the top cover thereof.
Figure 5:
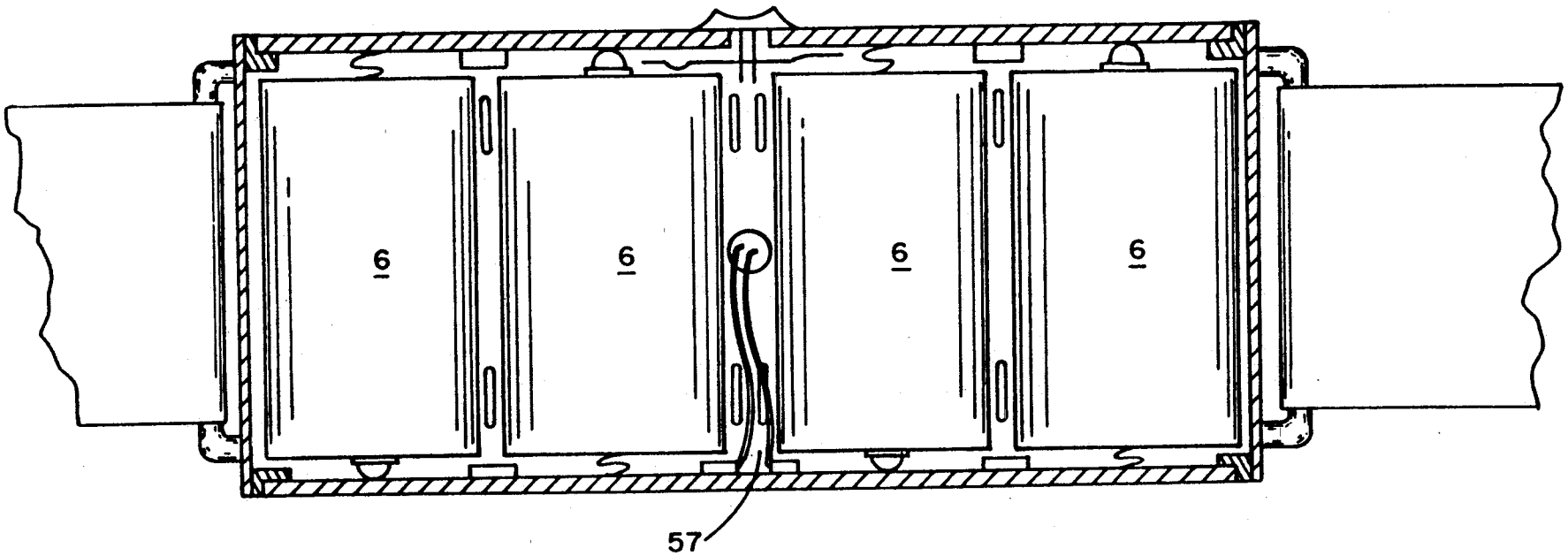
FIG. 5 is a sectional rear view of FIG. 3.

The holder 30 is hollow and in this embodiment the holder interior is accessible via the top 32 which is substantially comprised of a snap-in cover 37 as illustrated in FIG. 4. Also in this embodiment, the light 51 is battery-powered. As is illustrated in FIG. 5 the batteries 6 are contained within the holder 30. The wires 57 from the light socket 52 within the light housing 50 are passed through the extension element central opening 56, between the holder extension prongs 48, through the holder front 35, and into the holder 30 for connection to the batteries 6.

It is understood that the above-described embodiment is merely illustrative of the application. Other embodiments may be readily devised by those skilled in the art which will embody the principles of the invention and fall within the spirit and scope thereof.

I claim:

1. A safety light belt worn by a person comprising:

a belt having two ends, an outer face and an inner face;

a holder attached centrally to the belt outer face and having a back, top, bottom, two sides and a front;

a light housing assembly with forward and rearward ends and containing illumination means adjustably connected to said holder and adjustably positioned therein so that said light housing assembly may illuminate an area forwardly upward, horizontal, or downward from a worn position on a person;

power supply means contained within said holder and electrically connected to said illumination means within said light housing assembly;

said holder containing a holder extension element protruding horizontally from its front;

said light housing assembly being attached to said holder extension element; and wherein said holder extension element is formed into two flat, prongs, each having an external side, and two ends, a holder end and an extension end, each extension end having a semicircular shape and a plurality of open, circular notches said circular notches positioned with respect to a horizontal reference forward of the holder, and along each holder extension element eternal side, an obtuse triangular opening formed at the approximate mid-point of the diameter chord line of said semicircular shaped.

2. A safety light belt in accordance with claim 1 wherein:

a corner of the obtuse triangular opening defined by an obtuse angle, the corner, is centered on a longitudinal axis of the extension element and is a foremost point of the obtuse triangular opening; and the side opposite the obtuse angle is formed into plurality of open radial notches corresponding in number and angle to the extension element and circular notches.

3. A safety light belt in accordance with claim 2 wherein:

said light housing assembly has a light bulb inserted into a socket contained therein with a transparent protective element enclosing the forward end of the light housing assembly, and a horizontal extension element attached to the rearward end of said light housing assembly, said horizontal extension element having a central opening, two external sides, and two peg like protrusions on each side aligned horizontally along the horizontal extension element longitudinal axis.

4. A safety light belt in accordance with claim 3 wherein:

the light housing assembly extension element is joined to the holder extension element by said light housing assembly extension element fitting between the prongs of said holder extension element and a first peg fitting within the obtuse triangular opening of said holder extension element; and at the end of said prongs closest to the light housing assembly, said circular notches with each is selected to associated with a second peg, so that by sliding said light housing assembly extension element in the direction of the holder extension element, said first and second pegs become firmly held by radial and circular notches located within said triangular opening and prongs respectively with an angle of the light housing assembly to holder extension element directly corresponding to the notches selected.

5. A safety light belt in accordance with claim 4 wherein:

the radial and circular notches located within said obtuse triangular opening and at the end of the prongs closest to said light housing assembly being of less diameter than said first and second peg respectively.

6. A safety light belt in accordance with claim 5 wherein:

said power supply means are batteries.

7. A safety light belt in accordance with claim 6 wherein:

said electrical connection is comprised of wires from the socket passing through said housing extension element central opening, between the holder extension prongs, through the holder front, and into said holder for connection to said batteries.

* * * * *